US011208935B2

(12) United States Patent
Kurpejovic et al.

(10) Patent No.: US 11,208,935 B2
(45) Date of Patent: Dec. 28, 2021

(54) MIXER

(71) Applicant: Eberspächer Exhaust Technology GmbH, Neunkirchen (DE)

(72) Inventors: Enver Kurpejovic, Kirchheim unter Teck (DE); Florian Friedrich, Esslingen (DE); Ruben Hass, Stuttgart (DE); Krishna Kumar Vempati, Esslingen (DE); Sandra Hoeckel, Esslingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 16/913,449

(22) Filed: Jun. 26, 2020

(65) Prior Publication Data

US 2020/0408131 A1 Dec. 31, 2020

(30) Foreign Application Priority Data

Jun. 28, 2019 (DE) ..... 10 2019 117 459.7

(51) Int. Cl.

| | |
|---|---|
| ***F01N 3/20*** | (2006.01) |
| ***F01N 3/28*** | (2006.01) |
| ***B01F 3/04*** | (2006.01) |
| ***B01F 5/04*** | (2006.01) |
| ***B01F 5/06*** | (2006.01) |

(52) U.S. Cl.

CPC ..... *F01N 3/2892* (2013.01); *B01F 3/04049* (2013.01); *B01F 5/0473* (2013.01); *B01F 5/0606* (2013.01); *F01N 3/2066* (2013.01); *F01N 2240/20* (2013.01); *F01N 2610/02* (2013.01); *F01N 2610/1453* (2013.01)

(58) Field of Classification Search

CPC .. F01N 3/2066; F01N 3/2892; F01N 2240/20; F01N 2610/02; F01N 2610/1453; B01F 3/04049; B01F 5/0473; B01F 5/0606

USPC ..... 60/324

See application file for complete search history.

(56) References Cited

U.S. PATENT DOCUMENTS

| | | | | |
|---|---|---|---|---|
| 10,287,948 | B1 * | 5/2019 | Moulieres ..... | B01D 46/0027 |
| 2019/0010850 | A1 | 1/2019 | Willats et al. | |
| 2020/0032692 | A1 | 1/2020 | Wang et al. | |

FOREIGN PATENT DOCUMENTS

| | | | |
|---|---|---|---|
| CN | 208669387 | U | 3/2019 |
| DE | 102019210877 | A1 | 1/2020 |

(Continued)

*Primary Examiner* — Audrey B. Walter

(74) *Attorney, Agent, or Firm* — McGlew and Tuttle, P.C.

(57) ABSTRACT

A mixer for an exhaust system of an internal combustion engine includes a first mixer part (12) with a plate shape body (14) having an incoming upstream flow side (18), with respect to an exhaust gas main flow direction (A) and a downstream outflow side (22), and a second mixer part (24), on an outflow side, with a bottom wall (26) spaced apart from the plate shape body and with two side walls (28, 30), extending from the bottom wall (26) towards the plate shape body and fixed at the first mixer part. The mixer parts define a reactant injection duct (32) receiving reactant in a main injection direction (R). An exhaust gas main passage opening (54) the plate shape body opens towards the reactant injection duct with a plurality of exhaust gas secondary passage openings (78, 80, 82, 84, 86, 88, 90, 92) run past the injection duct.

22 Claims, 6 Drawing Sheets

(56) References Cited

FOREIGN PATENT DOCUMENTS

| | | | |
|---|---|---|---|
| WO | 2015/012829 | A1 | 1/2015 |
| WO | 2018222180 | A1 | 12/2018 |

* cited by examiner

MIXER

CROSS REFERENCE TO RELATED APPLICATIONS

This application claims the benefit of priority under 35 U.S.C. § 119 of German Application 10 2019 117 459.7, filed Jun. 28, 2019, the entire contents of which are incorporated herein by reference.

TECHNICAL FIELD

The present invention pertains to a mixer for an exhaust system of an internal combustion engine, which mixer is used to bring about the mixing of reactant injected into the exhaust gas stream, for example, a urea/water solution, with the exhaust gas.

TECHNICAL BACKGROUND

To reduce the nitrogen oxide content in the exhaust gas discharged by a diesel internal combustion engine, it is known that a reactant is injected into the exhaust gas stream to carry out a selective catalytic reduction (SCR) in order to bring about a catalytic reaction of the nitrogen oxide being transported in the exhaust gas on an SCR catalytic converter. Good mixing of the reactant with the exhaust gas is necessary to carry out this catalytic reaction efficiently.

SUMMARY

An object of the present invention is to provide a mixer for an exhaust system of an internal combustion engine, which mixer brings about an efficient mixing of a reactant injected into the exhaust gas stream with the exhaust gas while generating a low flow resistance for the exhaust gas flowing in an exhaust system and has a compact configuration.

This object is accomplished according to the present invention by a mixer for an exhaust system of an internal combustion engine, comprising:

- a first mixer part with a plate shape body with an incoming flow side to be arranged oriented in the upstream direction with respect to an exhaust gas main flow direction and with an outflow side to be arranged oriented in the downstream direction with respect to the exhaust gas main flow direction, and
- a second mixer part arranged on the outflow side of the first mixer part with a bottom wall arranged at a spaced location from the plate shape body of the first mixer part and with two side walls, which originate from the bottom wall and extend towards the plate shape body of the first mixer part and are fixed at the first mixer part, wherein the second mixer part with its bottom wall and with its side walls and the first mixer part with its plate shape body define a reactant injection duct for receiving reactant in a reactant main injection direction, and wherein at least one and preferably an only exhaust gas main passage opening open to the reactant injection duct is provided in the plate shape body of the first mixer part and a plurality of exhaust gas secondary passage openings running past the reactant injection duct are provided.

A compact configuration, which can be manufactured with a small number of components and can be manufactured in a simple and cost-effective manner, is obtained with the mixer configured according to the principles of the present invention. The mixer can easily be adapted to the mixing process to be provided for different types of injectors and is insensitive with respect to the different spray angles generated by different types of injectors.

It is further proposed for a configuration that can be manufactured in a simple manner that the plate shape body of the first mixer part and the bottom wall of the second mixer part be arranged essentially parallel to one another, or/and that the two side walls of the second mixer part be arranged essentially parallel with respect to one another, or/and that the two side walls of the second mixer part be arranged essentially at right angles with respect to the bottom wall of the second mixer part or/and to the plate shape body of the first mixer part.

A stable configuration that can, for example, easily be integrated into an exhaust gas pipe can be obtained by a circumferential edge extending from the plate shape body in a direction away from the incoming flow side being provided at an outer circumference of the first mixer part.

To receive reactant from an injector, which is arranged, for example, outside an exhaust gas pipe, the reactant injection duct may be open in a first area of the outer circumference of the first mixer part at a receiving end for receiving reactant.

In order to obtain a flush connection also of the bottom wall to the exhaust gas pipe, for example, in interaction with the wall of an exhaust gas pipe, it is proposed that an outer circumferential contour of the bottom wall of the second mixer part in the first area of the outer circumference of the first mixer part correspond essentially to an outer circumferential contour of the first mixer part.

In order to make it possible to pass on the reactant injected into the reactant injection duct or the mixture of reactant and exhaust gas, which mixture was generated already in the reactant injection duct, the reactant injection duct may be open at a release end for releasing reactant or/and exhaust gas.

An intensified mixing of exhaust gas and reactant at the releasing end of the reactant injection duct can be ensured, for example, by the bottom wall of the second mixer part extending with a bottom wall extension area beyond the side walls of the second mixer part.

In order to avoid leakage flows compromising the mixing, it is proposed that the bottom wall extension area extend essentially to a second area of the outer circumference of the first mixer part and that an outer circumferential contour of the bottom wall extension correspond in the second area of the outer circumference of the first mixer part essentially to an outer circumferential contour of the first mixer part.

The mixing of exhaust gas and reactant at the releasing end of the reactant injection duct can be further supported by a deflecting wall extending essentially at right angle to the reactant main injection direction being arranged between the bottom wall extension area of the second mixer part and the plate shape body of the first mixer part. In order to bring about a defined flow deflection in the process, it is proposed that the deflecting wall have an essentially W-shaped or V-shaped configuration.

The deflecting wall may define with the plate shape body of the first mixer part, with the bottom wall extension area of the second mixer part and with each of the side walls of the second mixer part a respective main discharge opening of the reactant injection duct. A defined flow guiding is thus guaranteed at the releasing end through this main discharge opening or main discharge openings.

An efficient inflow of exhaust gas into the reactant injection duct can be supported by the exhaust gas main passage opening having an increasing opening width with respect to the exhaust gas main flow direction and to a central area of the plate shape body of the first mixer part in a first radial extension area originating from a radially outer end of the exhaust gas main passage opening and a decreasing opening width in a second radial extension area leading to a radially inner end of the exhaust gas main passage opening, the length of the second radial extension area being greater than a length of the first radial extension area.

To also achieve a defined flow guiding for the exhaust gas in an area next to the reactant injection duct, which flow guiding supports the mixing of exhaust gas and reactant, it is proposed that the exhaust gas secondary passage openings comprise a plurality of first exhaust gas secondary passage openings having a hole-like (hole) configuration, or/and that the exhaust gas secondary passage openings comprise a plurality of second exhaust gas secondary passage openings, wherein a flow deflection element is provided at the first mixer part in association with each second exhaust gas secondary passage opening.

In association with each second exhaust gas secondary passage opening, a bulge projecting on the outflow side may be provided at the plate shape body of the first mixer part for providing the flow deflection element. The bulge may have, for example, essentially the form of a calotte shell segment or of a deflecting flap.

The mixing of exhaust gas and reactant especially where reactant is discharged from the reactant injection duct can be made efficient by a second exhaust gas secondary passage opening being provided at the first mixer part in the area of at least one and preferably each main discharge opening, the flow deflection element associated with this second exhaust gas secondary passage opening deflecting exhaust gas passing through this secondary passage opening in the direction away from the reactant injection duct.

A plurality of secondary passage openings may be provided in the second mixer part. The provision of such secondary passage openings also supports the mixing of exhaust gas and reactant.

For example, the secondary discharge openings may comprise a plurality of first secondary discharge openings having a hole configuration. As an alternative or in addition, the secondary discharge openings may comprise a plurality of second secondary discharge openings, and a flow deflection element is provided at the second mixer part in association with each second secondary discharge opening.

A bulge may also be provided in association with each second secondary discharge opening at the second mixer part for providing the flow deflection element, and the bulge has, for example, essentially the form of a calotte shell segment or a deflecting flap.

The defined flow guiding in the area of the main passage opening(s) may be supported by a flow deflection element oriented in the direction away from the reactant injection duct being provided at least one and preferably each of the side walls of the second mixer part. Such a flow deflection element may have, for example, the form of a deflecting flap.

It is proposed for a configuration that can be embodied in a simple manner and is especially resistant to thermal effects that the first mixer part or/and the second mixer part be configured as a shaped sheet metal part.

The present invention further pertains to an exhaust system for an internal combustion engine, comprising an exhaust gas duct, through which exhaust gas can flow, and a mixer, which is configured according to the present invention and is arranged in the exhaust gas duct such that the first mixer part with its incoming flow side is oriented with its incoming flow side essentially at right angles to the exhaust gas main flow direction in the area of the mixer.

A reactant injection device may be provided for injecting reactant into the reactant injection duct.

An especially efficient mixing of exhaust gas and reactant can be supported here by the reactant main injection direction being essentially at right angles to the exhaust gas main flow direction in the exhaust gas duct on the incoming flow side of the first mixer part.

Provisions may be made in a configuration that likewise ensures a very good mixing of reactant and exhaust gas for the reactant injection device to be arranged for injecting reactant into the reactant injection duct through the exhaust gas main passage opening.

The present invention will be explained in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
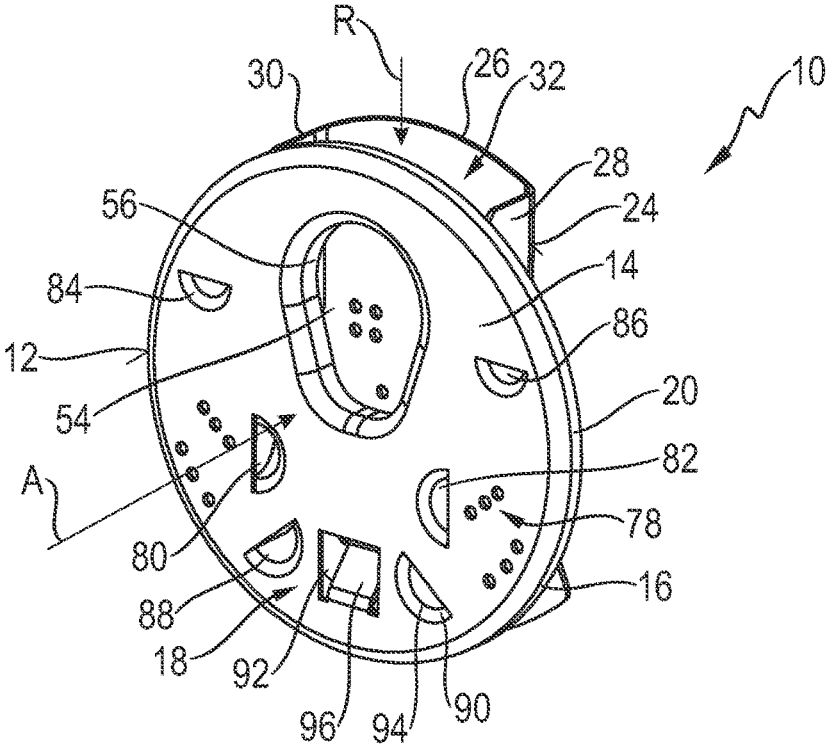
FIG. 1 is a perspective view of a mixer when viewed from an incoming flow side of a first mixer part thereof.
Figure 2:
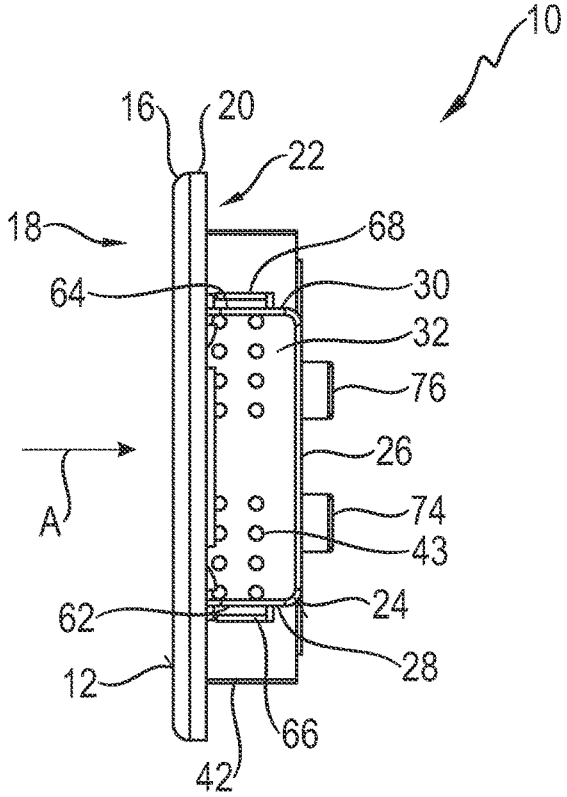
FIG. 2 is a side view of the mixer according to FIG. 1, viewed in the direction of a reactant main injection direction in FIG. 1.

Referring to the drawings, FIGS. 1 through 5 show different views of a mixer generally designated by 10 for an exhaust system of an internal combustion engine, for example, in a motor vehicle. The mixer 10 comprises a first mixer part 12 provided as a shaped sheet metal part with an essentially flat, plate shape body 14. On an outer circumference 16 of the first mixer part 12, the plate shape body 14 is adjoined by an edge 20, which extends in the direction away from an incoming flow side 18 shown in FIG. 1 and is cylindrical in at least some areas. The mixer 10 can be arranged and fixed with this edge 20 such that it is in contact with the inner surface of an exhaust gas pipe.

A second mixer part 24 likewise provided as a shaped sheet metal part is provided on the outflow side 22 of the first mixer part 12, which said outflow side is oriented opposite the incoming flow side 18. The second mixer part 24 is configured with a bottom wall 26 and with side walls 28, 30 bent off from this at lateral areas. The side walls 28, 30 extend, starting from the bottom wall 26, towards the outflow side 22 of the plate shape body 14 of the first mixer part 12 and are fixed thereto, for example, by welding.

The second mixer part 24 is arranged with its bottom wall 26 essentially parallel to the plate shape body 14 of the first mixer part 12. The two side walls 28, 30 extend essentially at right angles to the bottom wall 26 and the plate shape body 14 and are essentially parallel to one another. A reactant injection duct 32 having an approximately rectangular cross section is defined in this manner by the bottom wall 26 of the second mixer part 24 and the two side walls 28, 30 of the second mixer part 24.

A receiving end 34 of the reactant injection duct 32 is located in a first area 36 of the outer circumference 16 of the first mixer part 12. The bottom wall 26 of the second mixer part 24 is formed in the area of the receiving end 34 of the reactant injection duct 32 with an outer circumferential contour adapted to the outer circumferential contour of the first mixer part 12, so that the second mixer part 24 can also adjoin the inner surface of an exhaust gas pipe essentially flush and leakage flows can be extensively avoided in this area. In case an exhaust gas pipe receiving the mixer 10 has, for example, an essentially circular cross-sectional contour, the outer circumferential contour of the first mixer part may correspond essentially to a circular contour. The outer circumferential contour of the bottom wall 26 in the area of the receiving end 34 of the reactant injection duct 32 may accordingly also correspond to a circular shape or to the segment of a circle.

The second mixer part 24 extends with a bottom wall extension area 38 beyond the side walls 28, 30 to a second area 40 of the outer circumference 16 of the first mixer part 12. The second mixer part 24 ends with an outer circumferential contour, which corresponds essentially to the outer circumferential contour of the first mixer part 12, in the bottom wall extension area 38 as well in order to obtain an essentially flush connection of the first mixer part 12 to the inner surface of an exhaust gas pipe in this area as well.

A deflecting wall 42, which is provided, for example, likewise as a shaped sheet metal part, is provided between the bottom wall extension area 38 and the plate shape body 14 of the first mixer part 12. The deflecting wall 42 has a plurality of passage openings 43 and is configured in the exemplary embodiment shown with an approximately W-like shape and it deflects a stream of reactant and exhaust gas, which is formed in the reactant injection duct 32, to respective main discharge openings 46, 48 formed in the area of a releasing end 44 of the reactant injection duct 32. Each of these main discharge openings 46, 48 is defined by the plate shape body 14 of the first mixer part 12, by one of the two side walls 28, 30, by the deflecting wall 42 and by the bottom wall extension area 38. As is indicated by flow arrows in FIG. 3, the mixture of reactant and exhaust gas flows under the guiding effect of the deflection element 42 approximately in the circumferential direction with respect to an exhaust gas main flow direction A, with which the exhaust gas flows towards the incoming flow side 18 of the first mixer part 12.

To support the flow guiding in the area of the main discharge openings 46, 48, flow deflection elements 50, 52 are provided at the side walls 28, 30, said flow deflection elements 50, 52 having the form of deflecting flaps, which are oriented in the direction away from the reactant injection duct 32 or from the releasing end 44 thereof. A nozzle effect contributing to the flow acceleration and hence to improved mixing can be generated in this manner in the area of the main discharge openings 46, 48.

In order to make possible the entry of exhaust gas into the reactant injection duct 32, an exhaust gas main passage opening 54 is formed in the plate shape body 14 of the first mixer part 12. This main passage opening 54 is located opposite the bottom wall 26 of the second mixer part 24 and is enclosed by an edge 56 extending in the direction away from the incoming flow side 28. The exhaust gas main passage opening 54 has approximately a drop-like shape, in which, starting from an end that is a radially outer end with respect to a central area of the plate shape body 14 and with respect to the exhaust gas main flow direction A, the width, i.e., the extension in the circumferential direction, at first increases in a first radial extension area and then decreases again in a second extension area in the direction of a radially inner end of the exhaust gas main passage opening 54. The length of extension, in which the width decreases again, is greater here than the length of extension, in which the width increases at first, starting from the radially outer end of the exhaust gas main passage opening.

The exhaust gas stream or a part of it, which flows in the exhaust gas main flow direction A towards the incoming flow side 18 of the first mixer part 12, passes through the exhaust gas main passage opening 54 and into the reactant injection duct 32. Reactant, which is injected in a reactant main injection direction R into the reactant injection duct 32, is deflected at least partially by the exhaust gas flowing through the exhaust gas main passage opening 54 in the direction of the bottom wall 26, so that an area 58, shown in FIG. 3, in which the deflected reactant stream impinges on the bottom wall 26 and wets same, is formed at the bottom wall 26. This wetting with reactant leads to an intensified evaporation, because the bottom wall 26, just like all other areas of the mixer 10, are heated by the exhaust gas stream flowing around and through the mixer 10 to a comparatively high temperature.

The part of the exhaust gas stream entering into the reactant injection duct 32 through the exhaust gas main passage opening 54 is mixed already partially in the reactant injection duct 32 with the reactant injected into this injection duct and leaves the reactant injection duct 32, as was already described above, mostly via the two main discharge openings 46, 48 provided in association with the side walls 28, 30. Another part of the mixture of exhaust gas and reactant, which is formed in the reactant injection duct 32, leaves the reactant injection duct 32 via the passage openings 43 in the deflecting wall 42 and via hole first secondary discharge openings 60 formed in the bottom wall 26 and at the bottom wall extension area 38. These hole first secondary discharge openings 60 may be arranged in a plurality of groups at the bottom wall 26 and at the bottom wall extension area 38. A second secondary discharge opening 62 and 64, respectively, is provided in the area of each side wall 28, 30. While no flow deflection element is provided in association with the first secondary discharge openings 60, a flow deflection element 66, 68, which is provided by a configuration in the form of a deflecting flap, is provided in association with each of these second secondary discharge openings 62, 64. For example, each second secondary discharge opening 62, 64 may be provided with the flow deflection element 66, 68 associated with this secondary discharge opening 62, 64 by preparing a U-shaped incision in the associated side wall 28, 30 and by bulging or bending out the flow deflection element 66, 68 out of the plane of the respective side wall 28, 30.

Figure 3:
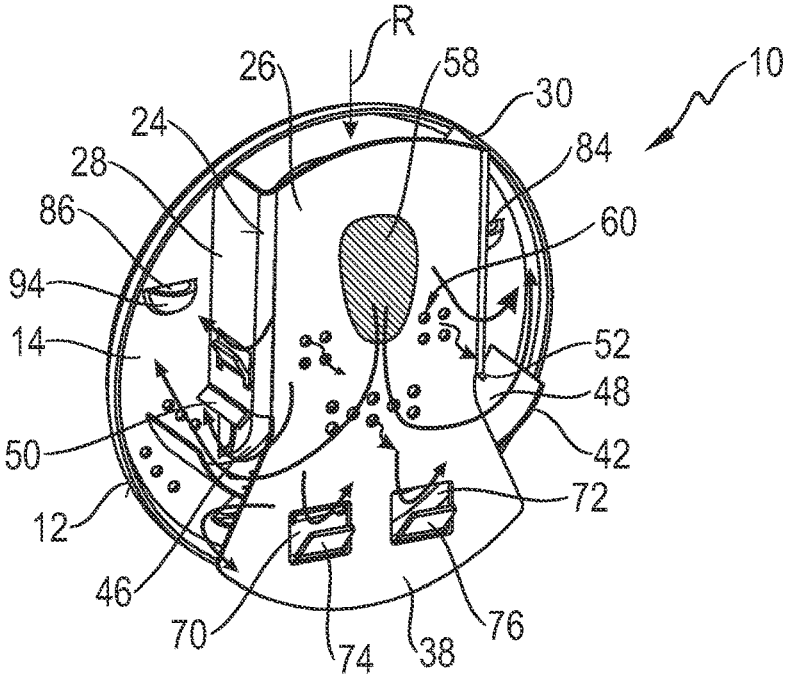
FIG. 3 is a perspective view of the mixer according to FIG. 1, viewed from the outflow side of the first mixer part thereof.
Figure 4:
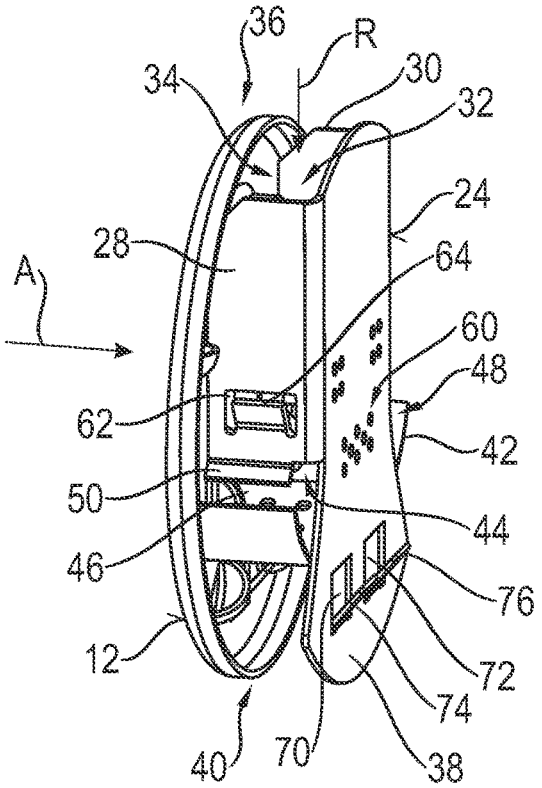
FIG. 4 is another perspective view of the mixture according to FIG. 1.
Figure 5:
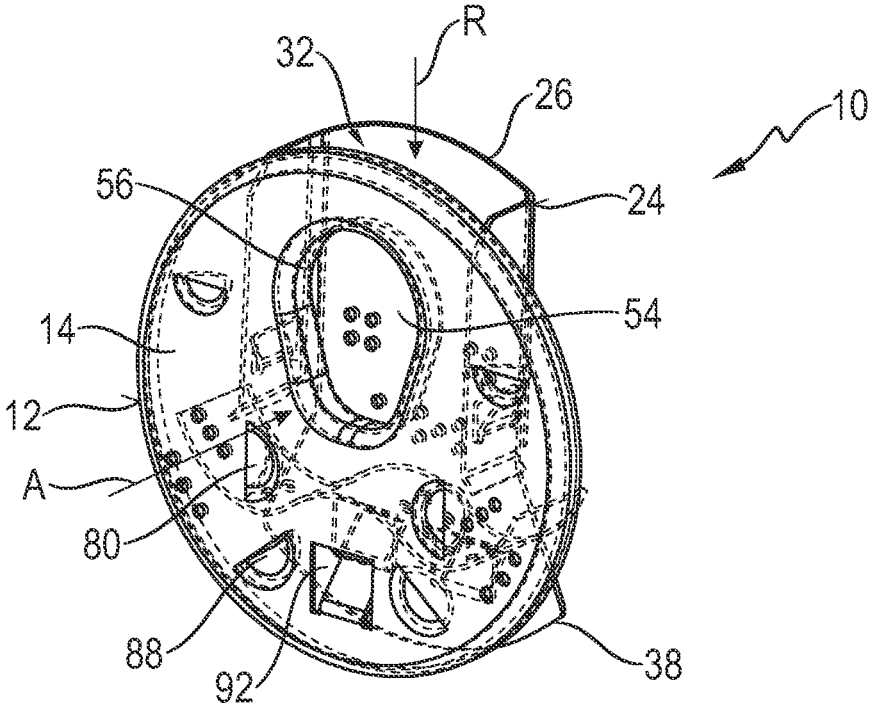
FIG. 5 is a transparent view of the mixer according to FIG. 1.

As can be seen in FIG. 3, the stream of exhaust gas and reactant, which stream leaves the reactant injection duct 32, supports the flow of the mixture of reactant and exhaust gas, which stream is generated in the reactant injection duct 32 and is oriented in the circumferential direction.

Such second secondary discharge openings 70, 72 with flow deflection elements 74, 76 associated with them are also provided in the bottom wall extension area 38. These flow deflection elements 74, 76 also ensure that the mixture of reactant and exhaust gas, which flows farther in this area, will be deflected in a direction differing from the exhaust gas main flow direction A, which contributes to the intensified mixing of exhaust gas and reactant.

First exhaust gas secondary passage openings 78 with an essentially hole shape are provided in the first mixer part 12 in areas next to the reactant injection duct 32. As can be seen in FIG. 1, the first exhaust gas secondary passage openings 78 are arranged in groups at the plate shape body 14 of the first mixer part 12 such that they are located in the areas in which the mixture of exhaust gas and reactant or a part of the mixture of exhaust gas and reactant leaves the reactant injection duct 32 in the area of the main discharge openings 46, 48. As a result, this stream is deflected in the direction of the exhaust gas main flow direction A, so that a spiral or helical flow is forced to take place on the downstream side 22 of the first mixer part 12.

Further, a plurality of second exhaust gas secondary passage openings 80, 82, 84, 86, 88, 90, 92 are provided in the plate shape body of the first mixer part 12. While no flow deflection element is associated with each first exhaust gas secondary passage opening 78 either, a respective flow deflection element 94 and 96 provided by bulging the plate shape body 14 is associated with each second exhaust gas secondary passage opening 80, 82, 84, 86, 88, 90, 92. While the flow deflection elements 94 provided in association with the second exhaust gas secondary passage openings 80, 82, 84, 86, 88, 90 formed with a semicircular contour have the form of a calotte shell segment, the flow deflection element 96, which is provided in association with the second exhaust gas secondary passage opening 92, is configured in the form of a deflecting flap.

The two second exhaust gas secondary passage openings 80, 82 are positioned at the plate shape body 14 of the first mixer part 12 such that they are located in the area of the main discharge openings 46, 48. The flow deflection elements 94 associated with these two second exhaust gas secondary passage openings 80, 82 are oriented such that they deflect the exhaust gas passing through these second exhaust gas secondary passage openings 80, 82 in a direction that corresponds essentially to the flow direction of the mixture leaving the reactant injection duct 32 in the area of the main discharge openings 46, 48, so that this flow is supported. The second exhaust gas secondary passage openings 84, 86, 88, 90 are also positioned such that the flow deflection elements 94 associated with these support the flow in the circumferential direction. The second exhaust gas secondary passage opening 92 with the flow deflection element 96 configured in the manner of a deflecting flap is positioned such that the exhaust gas stream passing through this exhaust gas secondary passage opening 92 flows through the flow deflection element 96 in the direction of the rear side of the deflecting wall 42, which rear side faces away from the reactant injection duct 32. This exhaust gas stream is also deflected in the circumferential direction by the deflecting wall 42 configured with a curved W shape and it thus likewise supports the swirling and hence the mixing of exhaust gas and reactant.

The majority of the exhaust gas stream impinging on the first mixer part 12 on the incoming flow side 18 passes through the exhaust gas main passage opening 54 in case of the above-described configuration of a mixer 10 and mixes with the reactant injected in the reactant main injection direction R. The part of the exhaust gas passing through the exhaust gas secondary passage openings 78, 80, 82, 84, 86, 88, 90, 92 supports the swirling on the outflow side 22 of the first mixer part 12. The deflection of the reactant injected into the reactant injection duct 32 in the reactant main injection direction R towards the bottom wall 26 of the second mixer part 24 leads to an intensified contact of the reactant with the heated bottom wall 26 and thus to an intensified evaporation. The mixture of reactant and exhaust gas, which is thus formed, is deflected at first, supported by the deflecting wall 42 configured with a curved W shape, essentially in the circumferential direction and is then deflected and carried along by the part of the exhaust gas passing through the exhaust gas secondary passage openings 78, 80, 82, 84, 86, 88, 90, 92 in the direction of the exhaust gas main flow direction A.

Figure 6:
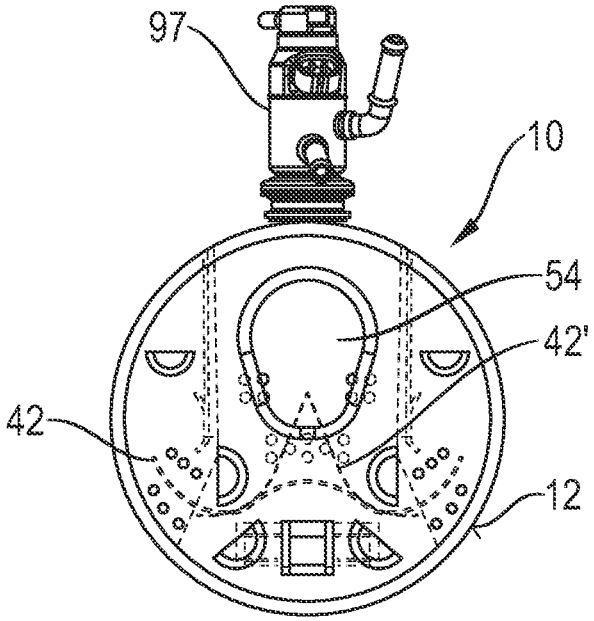
FIG. 6 is a transparent view of the mixer according to FIG. 1, viewed from the incoming flow side thereof, with an injector associated with the mixer.

FIG. 6 shows the mixer 10 as viewed from a mixer incoming flow side 18 and FIG. 6 illustrates that the deflecting wall 42 may also be configured with a different shape. While FIG. 6 shows with the double broken line the W-shaped, curved course of the deflecting wall 42, which can also be seen in FIG. 5, a course of the deflecting wall 42', in which the deflecting wall has approximately a curved V shape, is shown with a broken line.

Figure 7:
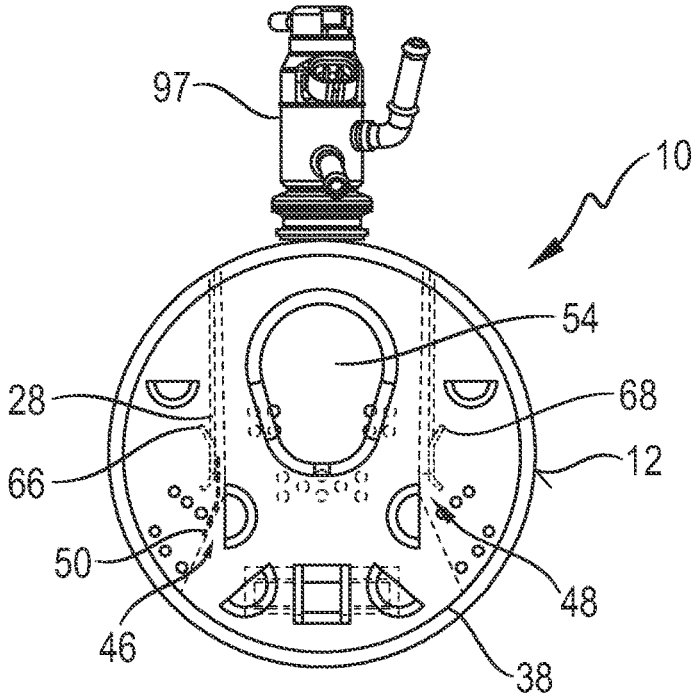
FIG. 7 is a view corresponding to FIG. 6 of an alternative type of configuration.

FIG. 7 shows a variation of the second mixer part 24 in the area of the main discharge openings 46, 48. As is illustrated by a thick broken line in FIG. 7, the side walls 28, 30 may have a different, especially a longer extension in the direction away from the receiving end 34 of the reactant injection duct 32. The flow deflection elements 66, 68 provided at these side walls 28, 30 may likewise be configured with a longer or shorter extension and with a different pitch angle than is shown, for example, in FIG. 6.

FIG. 7 shows, further, that the mixer 10 may also be configured without the deflecting wall provided between the plate shape body 14 of the first mixer part 12 and the bottom wall extension area 38 of the second mixer part 24. A defined flow deflection of the mixture of exhaust gas and reactant, which mixture leave the reactant injection duct 32, in the circumferential direction is achieved in this configuration as well especially due to the positioning of the different exhaust gas secondary passage openings and the flow deflection elements that are partially assigned to these.

It should further be noted that the number of exhaust gas secondary passage openings in the first mixer part 12 and the number of secondary passage openings in the second mixer part 24 may, of course, be selected such that these numbers are different than in the exemplary embodiment shown. This also pertains to the positioning of these openings.

Figure 8:
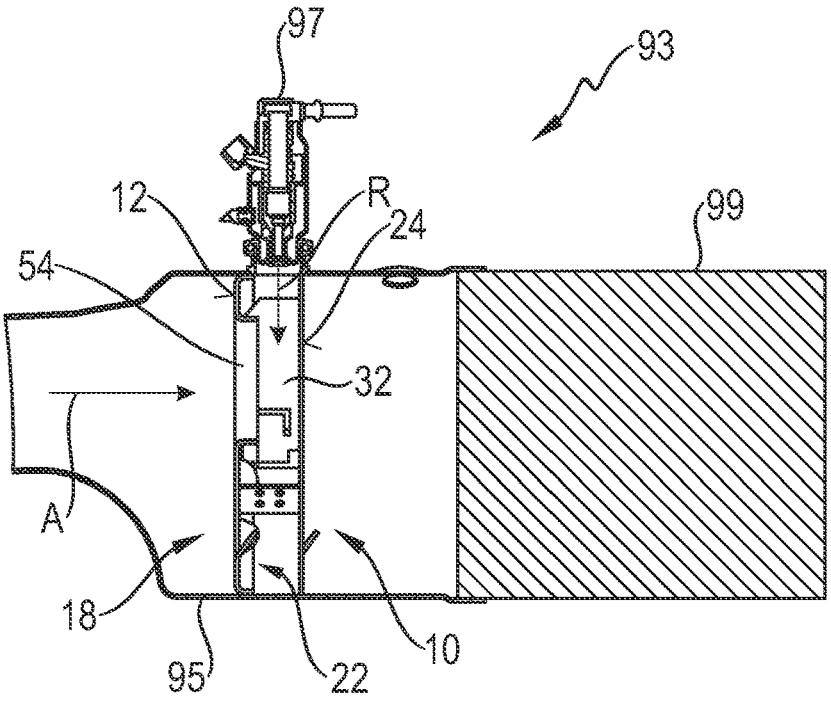
FIG. 8 is a longitudinal sectional view of an exhaust system with a mixer and with an injector associated with same.

FIG. 8 shows an exemplary embodiment of an exhaust system 93, in which the mixer 10 described above with reference to FIGS. 1 through 7 is provided. The exhaust system 93 has an exhaust gas pipe 95, which receives the mixer 10 and guides the exhaust gas stream in the direction of the exhaust gas main flow direction A towards the incoming flow side 18 of the first mixer part 12, with an exhaust gas duct formed in the exhaust gas pipe 95. The first mixer part 12 is fixed with its edge 20 at the inner surface of the exhaust gas pipe 95, for example, by welding. An injector, which is positioned essentially outside the exhaust gas pipe 95, is connected to this exhaust gas pipe 95, for example, in the area of a connection pipe 94 and provides generally a reactant injection device, releases the reactant in the reactant main injection direction R into the reactant injection duct 32. It should be noted that the reactant is released, in general, in the form of a spray cone, and the reactant main injection direction R may correspond to a central axis of this spray cone. The mixture of exhaust gas and reactant, which is formed in the mixer 10, leaves the mixer in the direction of an SCR catalytic converter 99 arranged downstream of the mixer.

It is seen clearly in FIG. 8 that the exhaust gas main flow direction A on the incoming flow side 18 of the first mixer part 12 and the reactant main injection direction R are approximately at right angles to one another, which brings about a highly efficient mixing of the exhaust gas stream passing through the exhaust gas main passage opening 54 with the reactant injected into the reactant injection duct 32.

Figure 9:
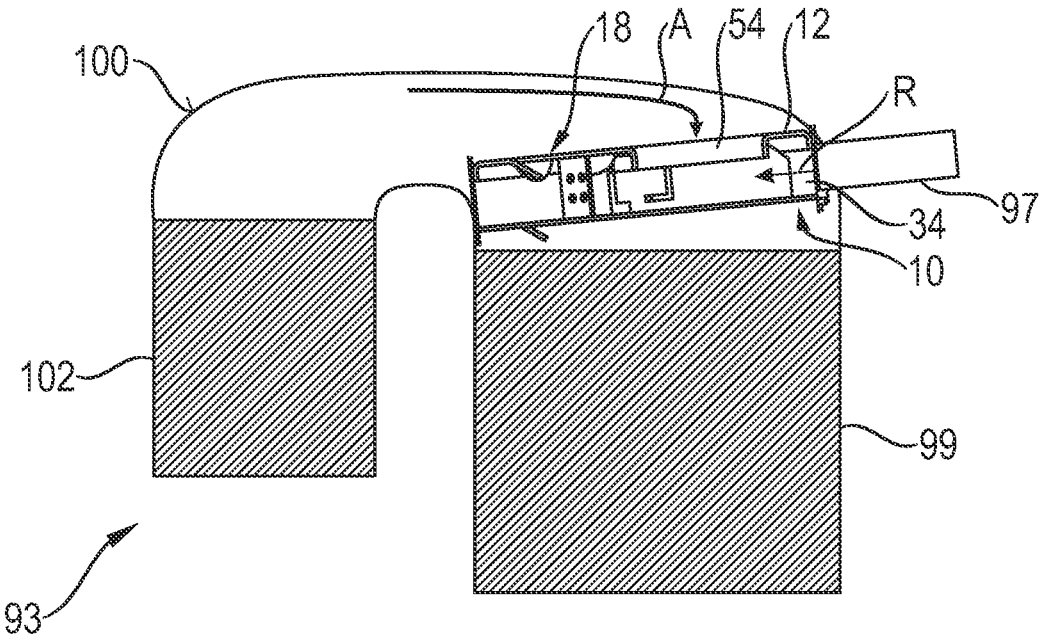
FIG. 9 is a longitudinal sectional view of an exhaust system having an alternative configuration.

FIG. 9 shows an embodiment of an exhaust system 93, in which the mixer 10 is positioned in a deflecting housing 100 providing the exhaust gas duct. This deflecting housing 100 deflects the exhaust gas stream released by an oxidation catalytic converter 102, for example, a diesel oxidation catalytic converter, by approximately 180° in the direction of the mixer 10 or of an SCR catalytic converter 99 arranged downstream of the mixer 10.

In this arrangement as well, the exhaust gas flowing towards the incoming flow side 18 of the first mixer part 12 has an exhaust gas main flow direction A, which is approximately at right angles to the reactant main injection direction R, in the area in which exhaust gas impinges on the first mixer part 12 and passes through the exhaust gas main passage opening 54, the reactant being injected into the reactant injection duct 32 through the injector 97 acting as a reactant injection device in the area of the receiving end 34.

Figure 10:
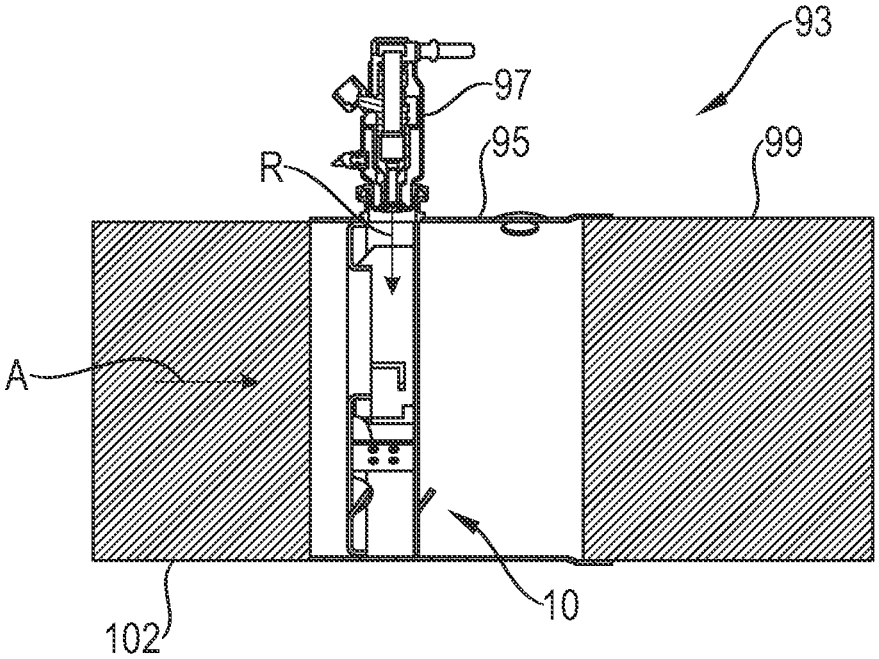
FIG. 10 is another longitudinal sectional view of an exhaust system having an alternative configuration.

FIG. 10 shows a linear arrangement of the oxidation catalytic converter 102, of the exhaust gas pipe 95 containing the mixer 10 and the SCR catalytic converter 99.

Figure 11:
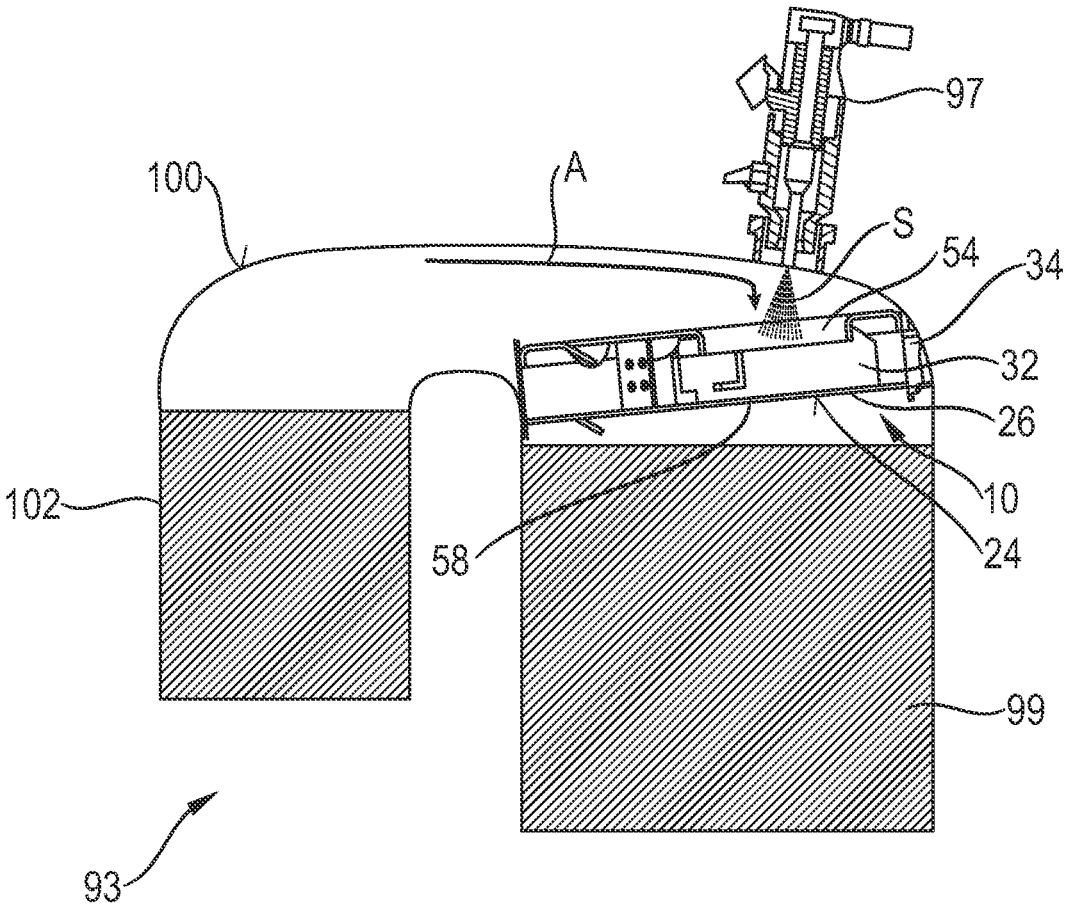
FIG. 11 is a view showing a variant of the exhaust system shown in FIG. 9.

FIG. 11 shows a variant of the embodiment of an exhaust system 93 shown in FIG. 9, wherein the difference can be found essentially in the positioning of the injector 97. The injector 97 is positioned at the deflecting housing 100 such that the spray cone S of the reactant, which spray cone S is released by this injector 97, is inserted through the exhaust gas main passage opening 54 into the reactant injection duct 32. The reactant now impinges now on the area 58 of the bottom wall 26 of the second mixer part 24, which area 58 is located opposite the exhaust gas main passage opening 54, so that wetting of the second mixer part 24, which supports the evaporation of the reactant more intensely, is achieved. The receiving end 34 of the reactant injection duct 32 may be covered or closed, for example, by the deflecting housing 100.

While specific embodiments of the invention have been shown and described in detail to illustrate the application of the principles of the invention, it will be understood that the invention may be embodied otherwise without departing from such principles.

What is claimed is:

1. An exhaust system mixer for an exhaust system of an internal combustion engine, the mixer comprising:

a first mixer part comprising a plate shape body with an incoming flow side to be arranged oriented in an upstream direction with respect to an exhaust gas main flow direction and with an outflow side to be arranged oriented in the downstream direction with respect to the exhaust gas main flow direction; and a second mixer part arranged on the outflow side of the first mixer part, the second mixer part comprising a bottom wall arranged at a spaced location from the plate shape body of the first mixer part and two side walls extending from the bottom wall towards the plate shape body of the first mixer part and fixed at the first mixer part, wherein:

the bottom wall, the side walls, and the plate shape body define a reactant injection duct for receiving reactant in a reactant main injection direction;

the plate shape body comprises an exhaust gas main passage opening, open towards the reactant injection duct;

the plate shape body comprises a plurality of exhaust gas secondary passage openings running past the reactant injection duct;

the reactant injection duct is open in a first area of an outer circumference of the first mixer part at a receiving end for receiving reactant and the reactant injection duct is open at a releasing end for releasing reactant or/and releasing exhaust gas; and the bottom wall of the second mixer part extends at the releasing end with a bottom wall extension area beyond the side walls of the second mixer part.

2. An exhaust system mixer in accordance with claim 1, wherein:

the plate shape body of the first mixer part and the bottom wall of the second mixer part are arranged essentially parallel to one another; or the two side walls of the second mixer part are arranged essentially parallel to one another; or the two side walls of the second mixer part are arranged essentially at right angles with respect to the bottom wall of the second mixer part; or the two side walls of the second mixer part are arranged essentially at right angles with respect to the plate shape body of the first mixer part; or any combination of the plate shape body of the first mixer part and the bottom wall of the second mixer part are arranged essentially parallel to one another, and the two side walls of the second mixer part are arranged essentially parallel to one another, and the two side walls of the second mixer part are arranged essentially at right angles with respect to the bottom wall of the second mixer part, and the two side walls of the second mixer part are arranged essentially at right angles with respect to the plate shape body of the first mixer part.

3. An exhaust system mixer in accordance with claim 1, wherein:

the first mixer part has a peripheral edge extending away from the plate shape body in a direction away from the incoming flow side; and the peripheral edge is provided at an outer circumference of the first mixer part.

4. An exhaust system mixer in accordance with claim 1, wherein in the first area of the outer circumference of the first mixer part, an outer circumferential contour of the bottom wall of the second mixer part corresponds essentially to an outer circumferential contour of the first mixer part.

5. An exhaust system mixer in accordance with claim 1, wherein:

the bottom wall extension area extends essentially up to a second area of the outer circumference of the first mixer part; and in the second area of the outer circumference of the first mixer part an outer circumferential contour of the bottom wall extension area of the second mixer part corresponds essentially to an outer circumferential contour of the first mixer part.

6. An exhaust system mixer in accordance with claim 1, wherein the exhaust gas main passage opening has an increasing opening width with respect to the exhaust gas main flow direction and with respect to a central area of the plate shape body of the first mixer part in a first radial extension area originating from a radially outer end of the exhaust gas main passage opening and a decreasing opening width in a second radial extension area leading to a radially inner end of the exhaust gas main passage opening, a length of the second radial extension area being greater than a length of the first radial extension area.

7. An exhaust system mixer in accordance with claim 1, wherein:

the exhaust gas secondary passage openings comprise a plurality of first exhaust gas secondary passage openings having a hole configuration; or the exhaust gas secondary passage openings comprise a plurality of second exhaust gas secondary passage openings, wherein a flow deflection element is provided at the first mixer part in association with each second exhaust gas secondary passage opening; or the exhaust gas secondary passage openings comprise a plurality of first exhaust gas secondary passage openings having a hole configuration and a plurality of second exhaust gas secondary passage openings, wherein a flow deflection element is provided at the first mixer part in association with each second exhaust gas secondary passage opening.

8. An exhaust system mixer in accordance with claim 1, wherein:

the exhaust gas secondary passage openings comprise a plurality of second exhaust gas secondary passage openings, wherein a flow deflection element is provided at the first mixer part in association with each second exhaust gas secondary passage opening; or the exhaust gas secondary passage openings comprise a plurality of first exhaust gas secondary passage openings having a hole configuration and a plurality of second exhaust gas secondary passage openings, wherein a flow deflection element is provided at the first mixer part in association with each second exhaust gas secondary passage opening; and wherein:

the flow deflection element comprises a bulge projecting on the outflow side at the plate shape body of the first mixer part in association with each second exhaust gas secondary passage opening; and the bulge comprises at least one of a calotte shell shape segment and a deflecting flap.

9. An exhaust system mixer in accordance with claim 1, wherein the first mixer part or/and the second mixer part is configured as a shaped sheet metal part.

10. An exhaust system mixer in accordance with claim 1, wherein at least one of the side walls, a flow deflection element is oriented in a direction away from the reactant injection duct of the second mixer part and forms a deflecting flap.

11. An exhaust system mixer in accordance with claim 10, wherein at each of the side walls, a flow deflection element is oriented in a direction away from the reactant injection duct of the second mixer part and forms a deflecting flap.

12. An exhaust system mixer in accordance with claim 1, wherein a plurality of secondary discharge openings are provided in the second mixer part.

13. An exhaust system mixer in accordance with claim 12, wherein the secondary discharge openings comprise:

a plurality of first secondary discharge openings having a hole configuration; or a plurality of second secondary discharge openings, wherein a flow deflection element is provided at the second mixer part in association with each second secondary discharge opening; or a plurality of first secondary discharge openings having a hole configuration and a plurality of second secondary discharge openings, wherein a flow deflection element is provided at the second mixer part in association with each second secondary discharge opening.

14. An exhaust system mixer in accordance with claim 12, wherein the secondary discharge openings comprise:

a plurality of second secondary discharge openings, wherein a flow deflection element is provided at the second mixer part in association with each second secondary discharge opening; or a plurality of first secondary discharge openings having a hole configuration and a plurality of second secondary discharge openings, wherein a flow deflection element is provided at the second mixer part in association with each second secondary discharge opening; and wherein:

a bulge for providing the flow deflection element is provided in association with each second secondary discharge opening at the second mixer part; and the bulge comprises one or more of a calotte shell segment and a deflecting flap.

15. An exhaust system mixer in accordance with claim 1, further comprising a deflecting wall extending essentially at right angles to the reactant main injection direction and arranged between the bottom wall extension area of the second mixer part and the plate shape body of the first mixer part.

16. An exhaust system mixer in accordance with claim 15, wherein the deflecting wall has an essentially W-shaped or V-shaped configuration.

17. An exhaust system mixer in accordance with claim 15, wherein the deflecting wall defines a respective main discharge opening of the reactant injection duct with the plate shape body of the first mixer part, with the bottom wall extension area of the second mixer part and with each of the side walls of the second mixer part.

18. An exhaust system mixer in accordance with claim 17, wherein:

a second exhaust gas secondary passage opening is provided at the first mixer part in an area of the main discharge opening; and a flow deflection element provided at the first mixer part associated with this second exhaust gas secondary passage opening deflects exhaust gas passing through the second exhaust gas secondary passage opening in the direction away from the reactant injection duct.

19. An exhaust system for an internal combustion engine, the exhaust system comprising:

an exhaust gas duct, through which exhaust gas can flow; and a mixer arranged in the exhaust gas duct, the mixer comprising:

a first mixer part comprising a plate shape body with an incoming flow side arranged oriented in an upstream direction with respect to an exhaust gas main flow direction and with an outflow side to be arranged oriented in the downstream direction with respect to the exhaust gas main flow direction; and a second mixer part arranged on the outflow side of the first mixer part, the second mixer part comprising a bottom wall arranged at a spaced location from the plate shape body of the first mixer part and two side walls extending from the bottom wall towards the plate shape body of the first mixer part and fixed at the first mixer part, wherein:

the bottom wall, the side walls, and the plate shape body define a reactant injection duct for receiving reactant in a reactant main injection direction;

the plate shape body comprises an exhaust gas main passage opening, open towards the reactant injection duct;

the plate shape body comprises a plurality of exhaust gas secondary passage openings running past the reactant injection duct; and the first mixer part is oriented with the incoming flow side essentially at right angles to the exhaust gas main flow direction in an area of the mixer; and the exhaust system further comprising:

a reactant injection device for injecting reactant into the reactant injection duct, wherein the reactant injection device is arranged for injecting reactant into the reactant injection duct through the exhaust gas main passage opening.

20. An exhaust system in accordance with claim 19, wherein the reactant main injection direction is essentially at right angles to the exhaust gas main flow direction in the exhaust gas duct on the incoming flow side of the first mixer part.

21. An exhaust system for an internal combustion engine, the exhaust system comprising:

an exhaust gas duct, through which exhaust gas can flow; and a mixer arranged in the exhaust gas duct, the mixer comprising:

a first mixer part comprising a plate shape body with an incoming flow side arranged oriented in an upstream direction with respect to an exhaust gas main flow direction and with an outflow side to be arranged oriented in the downstream direction with respect to the exhaust gas main flow direction; and a second mixer part arranged on the outflow side of the first mixer part, the second mixer part comprising a bottom wall arranged at a spaced location from the plate shape body of the first mixer part and two side walls extending from the bottom wall towards the plate shape body of the first mixer part and fixed at the first mixer part, wherein:

the bottom wall, the side walls, and the plate shape body define a reactant injection duct for receiving reactant in a reactant main injection direction;

the plate shape body comprises an exhaust gas main passage opening, open towards the reactant injection duct;

the plate shape body comprises a plurality of exhaust gas secondary passage openings running past the reactant injection duct; and the first mixer part is oriented with the incoming flow side essentially at right angles to the exhaust gas main flow direction in an area of the mixer;

the reactant injection duct is open in a first area of an outer circumference of the first mixer part at a receiving end for receiving reactant and the reactant injection duct is open at a releasing end for releasing reactant or/and releasing exhaust gas;

the bottom wall of the second mixer part extends at the releasing end with a bottom wall extension area beyond the side walls of the second mixer part.

22. An exhaust system mixer for an exhaust system of an internal combustion engine, the mixer comprising:

a first mixer part comprising a plate shape body with an incoming flow side to be arranged oriented in an upstream direction with respect to an exhaust gas main flow direction and with an outflow side to be arranged oriented in the downstream direction with respect to the exhaust gas main flow direction; and a second mixer part arranged on the outflow side of the first mixer part, the second mixer part comprising a bottom wall arranged at a spaced location from the plate shape body of the first mixer part and two side walls extending from the bottom wall towards the plate shape body of the first mixer part and fixed at the first mixer part, wherein:

the bottom wall, the side walls, and the plate shape body define a reactant injection duct for receiving reactant in a reactant main injection direction;

the plate shape body comprises an exhaust gas main passage opening, open towards the reactant injection duct;

the plate shape body comprises a plurality of exhaust gas secondary passage openings running past the reactant injection duct; and a plurality of secondary discharge openings are provided in the second mixer part.

* * * * *